US010557287B2

(12) United States Patent
Zaccaria

(10) Patent No.: US 10,557,287 B2
(45) Date of Patent: Feb. 11, 2020

(54) CASEMENT ARRANGEMENT HAVING A CASEMENT OF A WINDOW OR DOOR AND METHOD FOR THE FRONTAL INSTALLATION OF A FITTING PART IN A CASEMENT

(71) Applicants: WILH. SCHLECHTENDAHL & SÖHNE GMBH & CO. KG (WSS), Heiligenhaus (DE); SAPA AS, Oslo (NO)

(72) Inventor: Giovanni Zaccaria, Leinfelden Echterdingen (DE)

(73) Assignees: WILH. SCHLECHTENDAHL & SÖHNE GMBH & CO. KG (WSS), Heiligenhaus (DE); SAPA AS, Oslo (NO)

( * ) Notice: Subject to any disclaimer, the term of this patent is extended or adjusted under 35 U.S.C. 154(b) by 198 days.

(21) Appl. No.: 15/623,994

(22) Filed: Jun. 15, 2017

(65) Prior Publication Data

US 2017/0362857 A1 Dec. 21, 2017

(30) Foreign Application Priority Data

Jun. 16, 2016 (EP) ..... 16001358
Jun. 22, 2016 (EP) ..... 16001399
Mar. 22, 2017 (EP) ..... 17000479

(51) Int. Cl.
*E05B 65/06* (2006.01)
*E05D 15/52* (2006.01)
(Continued)

(52) U.S. Cl.
CPC ..... *E05B 65/06* (2013.01); *E05C 9/006* (2013.01); *E05D 15/523* (2013.01); *E06B 3/36* (2013.01);
(Continued)

(58) Field of Classification Search
CPC ..... E05B 65/06; E05D 15/523; E06B 3/36; E05C 9/006; E05Y 2900/148; E05Y 2600/412
(Continued)

(56) References Cited

U.S. PATENT DOCUMENTS 4,367,165 A * 1/1983 Asaoka ..... B01J 21/14 502/66
4,637,165 A 1/1987 Schneider
(Continued)

FOREIGN PATENT DOCUMENTS

DE 31 08 212 A1 9/1982
DE 92 12 415 U1 2/1993
(Continued)

*Primary Examiner* — Jeanette E Chapman
(74) *Attorney, Agent, or Firm* — Im IP Law; Chai Im; C. Andrew Im

(57) ABSTRACT

A casement/leaf arrangement having a casement/leaf of a window or door, with a frame profile of the casement/leaf. The frame profile having a C-shaped casement/leaf groove in the rebate, and with at least one fitting part, in particular a drive rod of a fitting, provided to be inserted into the casement/leaf groove. The casement/leaf groove has a first groove limb and a first groove portion and, located opposite, a second groove limb and a second groove portion. The fitting part has an elongate main body having a front side and a rear side. The main body has, on opposite longitudinal sides, a first peripheral region for engaging behind the first groove limb of the casement/leaf groove and a second peripheral region for engaging behind the second groove limb of the casement/leaf groove. The fitting part is pivotable into the casement/leaf groove with a peripheral region inserted into the groove portion.

13 Claims, 14 Drawing Sheets

(51) Int. Cl.
*E05C 9/00* (2006.01)
*E06B 3/36* (2006.01)
*E05D 15/523* (2006.01)

(52) U.S. Cl.
CPC ... *E05Y 2600/412* (2013.01); *E05Y 2900/148* (2013.01)

(58) Field of Classification Search
USPC ..... 49/503
See application file for complete search history.

(56) References Cited

U.S. PATENT DOCUMENTS 7,340,960 B2 * 3/2008 Niblock ..... G01L 1/18 73/760
7,752,809 B2 * 7/2010 Di Vinadio ..... E05D 15/5208 292/32
7,913,456 B2 * 3/2011 Balbo Di Vinadio .. E05C 9/021 29/270
8,161,683 B2 * 4/2012 Van Parys ..... E05D 15/52 292/141
8,579,340 B2 * 11/2013 Gledhill ..... E05B 15/0245 292/340
2008/0016782 A1 * 1/2008 Balbo Di Vinadio ..... E05D 15/5208 49/506
2017/0362857 A1 * 12/2017 Zaccaria ..... E05B 65/06
2018/0010371 A1 * 1/2018 Zaccaria ..... E05C 9/006

FOREIGN PATENT DOCUMENTS

EP 1318258 A2 * 6/2003 ..... E05C 9/20
EP 1867823 A1 * 12/2007 ..... E05D 15/5208
EP 1867824 A1 * 12/2007 ..... E05D 15/5208
EP 2955303 A1 * 12/2015 ..... E05C 9/006
EP 3258044 A1 * 12/2017 ..... E05B 65/06
GB 2 105 428 A 3/1983

* cited by examiner

CASEMENT ARRANGEMENT HAVING A CASEMENT OF A WINDOW OR DOOR AND METHOD FOR THE FRONTAL INSTALLATION OF A FITTING PART IN A CASEMENT

RELATED APPLICATIONS

This application claims priority from European Patent Application No. 16 001 358.7 filed Jun. 16, 2016, No. 16 001 399.1 filed Jun. 22, 2016 and No. 17 000 479.0 filed Mar. 22, 2017, each of which is herein incorporated by reference in its entirety.

FIELD OF THE INVENTION

The invention relates to a casement/leaf arrangement having a casement/leaf of a window or door, with a frame profile of a casement/leaf, said frame profile having a C-shaped casement/leaf groove in the rebate, and with at least one fitting part, in particular a drive rod, of a fitting, provided to be inserted into the casement/leaf groove, wherein the casement/leaf groove has a first groove limb and a first groove portion and, located opposite, a second groove limb and a second groove portion, wherein the fitting part has an elongate main body having a front side and a rear side, wherein the main body has, on opposite longitudinal sides, a first peripheral region for engaging behind the first groove limb of the casement/leaf groove and a second peripheral region for engaging behind the second groove limb of the casement/leaf groove. Furthermore, the invention relates to a method for the frontal installation of a fitting part in a C-shaped casement/leaf groove in the rebate of a frame profile of a casement/leaf, of a window or door.

Fittings are used in order to actuate a window casement or a door leaf. The term fitting in this case covers all the fitting parts which are installed in the rebate of the casement/leaf and are coupled to the fitting gear mechanism. The fitting gear mechanism is connected to a rotary handle which is provided on the outside of the casement/leaf and via which the individual fitting parts are actuated. The fitting parts are, for example, closing mechanisms, drive rods, tilt-locking devices, corner deflection means or scissor mechanisms, in particular rotary/tilt scissor mechanisms and/or the guides thereof. The respective fitting parts are in this case arranged in the rebate of the frame of the respective casement/leaf. To this end, the frame profile of the casement/leaf has, in the rebate, a C-shaped groove, in which the individual fitting parts are arranged usually in a displaceable manner and are ultimately connected to the fitting gear mechanism.

BACKGROUND OF THE INVENTION

U.S. Pat. No. 4,637,165 A, DE 31 08 212 A1 and DE 92 12 415 U1 each disclose casement/leaf arrangements in which the individual fitting parts are pushed at the end side into the open-ended C-shaped casement/leaf groove in the frame profile. A disadvantage with this type of installation is, in particular, that, when a fitting part needs to be exchanged, it is often difficult to carry out an exchange with the casement/leaf in the installed state.

OBJECT AND SUMMARY OF THE INVENTION

It is now the object of the present invention to provide a casement/leaf arrangement with which it is easily possible to install and remove a fitting part.

In order to achieve the abovementioned object, the invention essentially provides, in a casement/leaf arrangement of the type mentioned at the beginning, for the distance of the groove bottom of one groove portion from the free end of the groove limb of the other groove portion to be greater than the width of the fitting part. In other words, this means that the (clear) width of the main body is less than the (clear) distance of the first groove limb, or the free end thereof, from the opposite, furthest away end of the second groove portion at the groove bottom. As a result, it is possible to pivot the fitting part into the C-shaped casement/leaf groove with a longitudinal periphery inserted into the groove portion. In this case, the fitting part is inserted obliquely into the one groove portion and is then able to be pivoted into the casement/leaf groove.

In a corresponding manner, in the method according to the invention for frontal installation, the method provides for the fitting part to be inserted frontally with the one peripheral portion obliquely into one of the groove portions of the casement/leaf groove and subsequently to be pivoted into the casement/leaf groove.

Otherwise, it is advantageous in this connection for the width of the fitting part to be greater than the width of the free groove opening of the C-shaped casement/leaf groove, such that the fitting part engages behind the two groove limbs of the casement/leaf groove in the inserted or at least in the substantially centred state.

The solution according to the invention affords the substantial advantage that the arrangement of the fitting or of the fitting part in the casement/leaf arrangement is rendered easier not just upon first installation. In particular in the event of a subsequent exchange of a fitting part, it is readily possible, on account of the solution according to the invention, to carry this out even with the casement/leaf in the installed state.

In a preferred configuration of the invention, provision is otherwise made for a peripheral limb, protruding on the front side, for engaging behind a groove limb of the casement/leaf groove to be provided on at least one longitudinal side of the fitting part. In this connection, the longitudinal side of the main body is preferably angled in order to form the peripheral limb. A fitting part profile configured in such a way makes it easily possible for the fitting part to be pivoted into the casement/leaf groove when the fitting part is installed. Furthermore, as a result of the abovementioned configuration, it is possible to use a relatively thin or flat main body which, by way of the protruding peripheral limbs, ultimately corresponds at least substantially to the height or thickness of the casement/leaf groove.

In a preferred configuration of the invention, two spaced-apart angled limbs are otherwise provided on the front side of the main body, the free ends of said angled limbs being directed away from one another. In this case, provision is preferably additionally made for each angled limb to form, with the associated peripheral limb, a peripheral groove for the insertion of a further fitting part. In an alternative embodiment, provision is made for two spaced-apart angled limbs indeed to be provided on the front side of the main body, but for the free ends of said angled limbs to be directed towards one another, such that a C-shaped groove is formed, which is likewise configured for the insertion of a further fitting part into the groove.

As a result of the abovementioned configurations, a fitting part is ultimately provided which may in particular be a drive rod which as such forms the substructure or a base for fastening a further fitting part. It is also possible for the (first) fitting part to be a component in which at least one drive-rod extension is provided at the end in the longitudinal direction. In any case, this fitting part has a main body which is provided for insertion, and specifically for pivoting, into the casement/leaf groove of the casement/leaf. Pivoting-in is possible—as stated above—since the width of this fitting part is greater, at any rate in the region of the main body, than the free opening of the casement/leaf groove. In the pivoted-in state, the main body is not usually centred in the casement/leaf groove, however. This is because the casement % leaf groove ultimately has a greater width than the main body, and the main body is therefore arranged with play in the casement/leaf groove.

In a further preferred configuration of the invention, a cover that is able to be placed on the main body and at least substantially covers the front side of the main body is provided. The abovementioned cover first of all has the function of concealing the front side of the main body, or of the fitting part, which has been inserted into the casement/leaf groove, this not only having visual appearance reasons but also serving to protect against soiling.

It is particularly preferred in this connection for the cover to be releasably connectable to the main body. In particular the releasable connection can be realized via a latching connection.

Provision is furthermore made according to the invention for the main body to have a channel-like recess on its underside, between the angled limbs, forming a free space on the underside. Preferably, the main body has the same wall thickness in the region of the free space as elsewhere. The free space serves substantially to accommodate residues of material from the main body which can be produced for example when a punching screw is screwed in in order to fasten the further fitting part.

Otherwise, provision is made, in a preferred configuration of the invention, for the main body to be configured in a mirror-symmetrical manner in relation to its longitudinal centre axis. The mirror-symmetrical configuration has significant installation advantages, since, during installation, there is no need to pay close attention to the arrangement in which the main body or the fitting part is inserted into the casement/leaf groove.

As was mentioned above, the fitting part also serves in particular as a base for fastening a further fitting part. The further fitting part of the fitting is provided in particular for releasable connection to the fitting part and can be placed on and/or pushed onto the latter. In particular, the further fitting part can serve to centre the main body or the fitting part in the casement/leaf groove. In this case, the angled limbs or the peripheral grooves formed in each case between the angled limbs and the peripheral limbs, or the groove provided on the top side between the two angled limbs, serve to fasten the further fitting part to the fitting part. In this connection, it goes without saying that "insertion of the further fitting part" does not necessarily mean that the further fitting part is introduced completely into the groove. It is also possible for only a part or regions of the further fitting part to be inserted into the groove.

In order to interact with the fitting part, the further fitting part has a connection body. The connection body can ultimately be the main or basic body of the further fitting part, as is the case for example for a closing mechanism. However, the connection body can also be merely a connection element which is provided on the actual functional fitting part. This is the case for example when the connection body is provided on a tilt-locking device, a scissor mechanism or a corner deflection means. However, it is preferred in this case for the connection body either to be formed in one piece with the functional fitting element in question or to be at least firmly connected thereto. At any rate, in order to couple the fitting part to the further fitting part, it is the case that two feet having in each case at least one engagement protrusion for engaging in the peripheral grooves in the fitting part are provided on the underside of the connection body. The insertion of the feet into the peripheral grooves in the fitting part results in a secure arrangement of the further fitting part on the fitting part. All that then ultimately remains is for the further fitting part to be firmly connected to the fitting part at the location provided therefor in the groove. In the alternative embodiment in which only a groove between the angled limbs is provided on the drive rod, a foot having at least one engagement protrusion for engaging in the C-shaped groove in the fitting part is provided in a corresponding manner on the underside of the connection body. This then results in the secure arrangement of the further fitting part on the fitting part by the insertion of the foot into the C-shaped groove.

In order to realize a secure connection between the fitting part and the further fitting part, the feet have, on opposite sides, a respective engagement protrusion for engaging behind in each case one angled limb of the fitting part. Depending on the embodiment, the engagement protrusions are directed either towards one another or away from one another. In any case, as a result of the engagement protrusions engaging behind the angled limbs on each side, it is possible to ensure that the further fitting part is retained securely on the fitting part, even under the action of a high level of force.

In principle, at least one in particular releasable fastening means is provided in order to fasten the fitting part to the further fitting part. In a preferred configuration of the invention a screw-connection serves for this purpose. In particular, in this connection, a screw-connection through-opening for a screw, in particular a punching screw, for fixing the further fitting part to the fitting part is provided in the connection body. The screw-connection opening is preferably located in this case in the region of the longitudinal centre axis of the connection body, such that, when the further fitting part is being screwed to the fitting part, the screw acts on the elevation of the main body. In the case of a punching screw, which is provided for punching through the main body, punching residues, which are produced during the screw-connection and punching operations, are then received in the free space beneath the elevation.

In order to install the fitting parts, the latter are usually inserted into the casement/leaf groove and moved towards one another. This can be done by the one fitting part being moved in the direction of the other fitting part, or vice versa. In principle, it is also possible for the two fitting parts to be moved towards one another. For installation, when the further fitting part is intended to be fastened to the fitting part, the further fitting part is located in any case above the fitting part in the casement/leaf groove. In principle, it is also possible in this connection for the further fitting part to be placed directly on the fitting part in the casement/leaf groove and subsequently to be fixed, although this is not the general rule.

Regardless of which fitting part is moved in the direction of the other fitting part, in a preferred configuration of the invention, provision is made for a protrusion which tapers in a wedge-shaped manner towards its free end in the longitudinal direction and/or on its underside and is intended to be arranged between the angled limbs of the fitting part to be provided on at least one end side of the connection body. In particular, the wedge shape provided in the longitudinal direction of the protrusion can ensure that the main body of the fitting part is centred in the casement/leaf groove, specifically in particular such that the longitudinal centre axis of the main body extends directly above the longitudinal centre axis of the casement/leaf groove. The wedge shape on the underside of the protrusion ensures that, when the further fitting part is pushed onto the main body, the connection body is lifted via the slope on the underside of the protrusion, such that the further fitting part runs onto the main body of the fitting part, thereby considerably simplifying installation.

In a preferred configuration of the invention, the connection body is mirror symmetrical in relation to its longitudinal centre axis with regard to the foot or the feet, the limbs, the screw-connection opening and/or the protrusion. This facilitates the installation of the further fitting part on the fitting part in particular when the connection body is in the form of a closing mechanism.

According to the invention, the individual components of the casement/leaf arrangement are coordinated with one another, specifically such that the fitting part is able to be pivoted into the casement/leaf groove and firmly held therein in the mounted state, and such that the further fitting part is either able to be pivoted onto the first fitting part or pushed onto the latter or is able to be pushed up to the latter. In this case, the further fitting part is also coordinated with the casement/leaf groove in terms of its dimensions.

With regard to the further fitting part, the dimensions of the components of the casement/leaf groove and of the further fitting part are such that the distance between the outer sides of the limbs of the further fitting part is the same as or slightly smaller than the width of the free groove opening of the C-shaped casement/leaf groove. In this case, "slightly smaller" means that the fitting part is arranged in the free groove opening at least substantially without play or only with very little play, preferably at most 2 mm, in particular at most 1 mm. The smaller the play between the further fitting part and the free ends, directed towards one another, of the groove limbs of the casement/leaf groove, the more the centring of the fitting part in the casement/leaf groove is ensured.

In the installed state of the fitting parts, the feet of the further fitting part engage in the peripheral grooves in the main body of the fitting part, while the peripheral limbs of the fitting part each engage behind a groove limb of the casement/leaf groove.

According to the method, for the frontal installation of the fitting-part arrangement in the casement/leaf groove in the rebate of the frame profile of the casement/leaf, the invention provides for the fitting part to be inserted frontally with a longitudinal periphery into a groove portion of the casement/leaf groove and to be pivoted into the casement/leaf groove. Temporally before, at the same time as or temporally after this, the further fitting part is inserted into the casement/leaf groove at a different location than the fitting part. As has already been stated above, it is in principle also possible, after the fitting part has been pivoted in, for the further fitting part to be placed directly on the fitting part. However, as a rule, the one fitting part is moved in the direction of the other fitting part or both fitting parts are moved towards one another in the casement/leaf groove. Consequently, the further fitting part is located above the fitting part, specifically at the location at which the further fitting part is intended to be firmly connected to the fitting part. This then takes place preferably by way of a screw-connection, in particular by way of at least one punching screw.

It should be expressly noted that the fitting part with the angled limbs directed away from one another, which each form peripheral grooves with the associated peripheral limbs, also has independent inventive meaning, without the fitting part necessarily being part of a casement/leaf arrangement. However, such a fitting part is provided mainly for use in a casement/leaf arrangement of the abovementioned type.

BRIEF DESCRIPTION OF THE DRAWINGS

Further features, advantages and possible applications of the present invention can be gathered from the following description of exemplary embodiments with reference to the drawing and from the drawing itself. Here, all the features described and/or illustrated form separately, or in any desired combination, the subject matter of the present invention, regardless of how they are combined in the claims or how the latter refer back.

In the drawing.

DETAILED DESCRIPTION OF THE EMBODIMENTS

Figure 1:
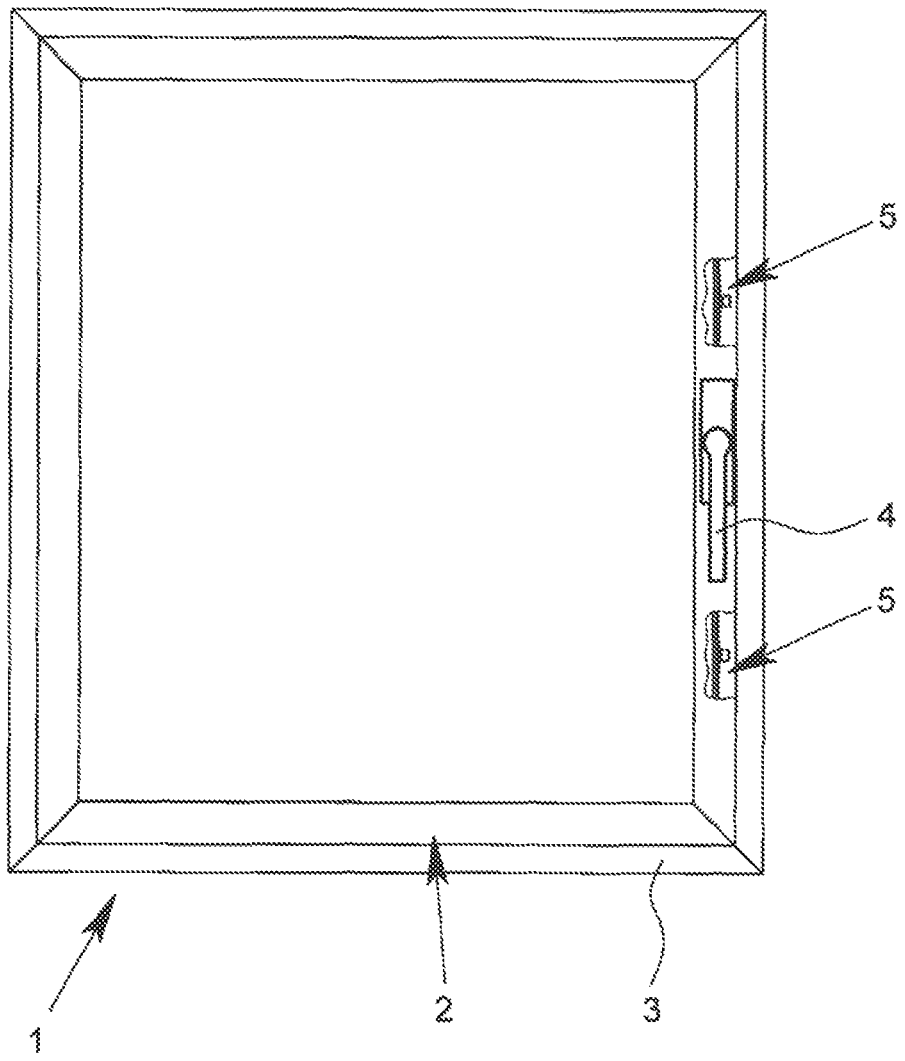
FIG. 1 shows a view of a window, partly in section.
Figure 2:
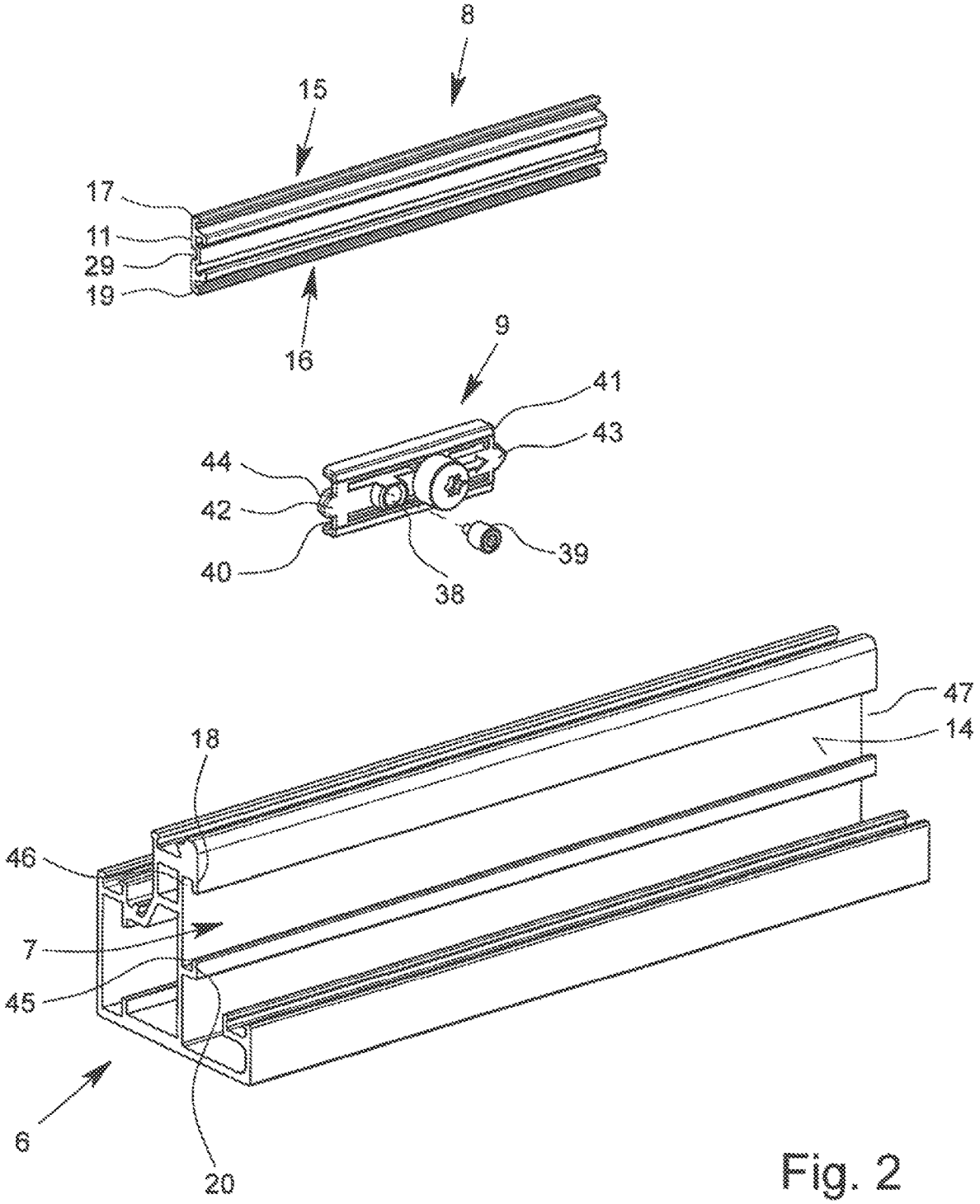
FIG. 2 shows a perspective illustration of part of a frame profile with a fitting part and a further fitting part.

FIG. 1 illustrates a casement arrangement 1 with a casement 2 of a window. The casement 2 is mounted in a pivotable manner on a frame 3. In order to open and close the casement 2, use is made of a handle 4, which is rotatable through 90° or 180° from the vertically oriented position illustrated. The handle 4 interacts with a fitting gear mechanism (not illustrated), which in turn interacts with a fitting 5. The casement 2 has an all-round frame profile 6, which has a C-shaped casement groove 7 that is open in the direction of the frame 3. The casement groove 7 is arranged in the rebate of the frame profile 6 of the casement 2.

In the exemplary embodiments illustrated, the fitting 5, which can be located at one or more locations in the rebate of the frame profile 6 of the casement 2, has at least one fitting part in the form of at least one drive rod 8. In the exemplary embodiments according to FIGS. 2 and 6 to 12, a further fitting part in the form of a closing mechanism 9 is provided, while in the embodiment according to FIGS. 13 and 14, the further fitting part is in the form of a tilt-locking device 10.

The fact that the further fitting part may also be in the form of a corner deflection means or scissor mechanism is not illustrated. What is said here in relation to the closing mechanism 9 and/or to the tilt-locking device 10 therefore also applies to further fitting parts with fundamentally different functions and designs. To this extent, what is said below in relation to the drive rod 8 and/or the closing mechanism 9 and/or the tilt-locking device 10 also relates to other possible fitting parts, which are usually arranged in the casement groove 7 in the rebate of the frame profile 6, even if these fitting parts are not specified individually in the following text.

The drive rod 8 has an elongate, flat main body 11, which has a front side 12 and a rear side 13. In the installed state, the rear side 13 is directed towards the bottom 14 of the casement groove 7. The front side 12 of the main body 11 is directed into the rebate or towards the frame 3. On opposite longitudinal sides 15, 16, the main body 11 has a first peripheral region 17 for engaging behind a groove limb 18 of the C-shaped casement groove 7 and a second peripheral region 19 for engaging behind a further groove limb 20 of the casement groove 7. The groove limbs 18, 20 have their free ends directed towards one another.

In conjunction with the drive rod 8 illustrated in FIGS. 2 to 14, it is the case that two spaced-apart angled limbs 21, 22, the free ends of which are directed towards one another, are provided on the front side of the main body 11. The angled limbs 21, 22, which—as seen in cross section—may also be of arcuate design in principle, since ultimately the only important thing is for an undercut to be formed by each of the angled limbs 21, 22, form a C-shaped groove 23 in the main body 11, which is provided for the insertion of the further fitting part into the groove 23.

In addition to the angled limbs 21, 22, the main body 11 has, on the two longitudinal sides 15, 16, a peripheral limb 24, 25 protruding on the front side, wherein the peripheral limbs 24, 25 are provided for engaging behind a groove limb 18, 20 of the casement groove 7. Ultimately, it is the longitudinal sides 15, 16 of the main body 11 that are angled in order to form the peripheral limbs 24, 25. Thus, two angled limbs 21, 22 and two peripheral limbs 24, 25 are located on the front side 12 of the main body 11. In this case, a limb groove 26, 27 is formed in each case between the angled limb 21 and the peripheral limb 24 and between the angled limb 22 and the peripheral limb 25.

An elevation 28 is located on the main body 11, between the two angled limbs 21, 22. A free space 29 is provided on the underside, in the region of the elevation 28. In the region of the elevation 28, the wall thickness of the main body 11 is the same as in the non-elevated region. In any case, the main body protrudes from the bottom 14 of the casement groove 7 in the region of the elevation 28, while otherwise the rear side 13 of the main body 11 rests against the bottom.

As can otherwise be gathered from various figures, the main body 11 is configured in a mirror-symmetrical manner in relation to its longitudinal centre axis M.

The closing mechanism 9 and also the tilt-locking device 10, as a further fitting part, each have a connection body 30, which has a rear side 31 and a front side 32. Located on the rear side of the connection body 30 is a foot 33 with opposite engagement protrusions 34, 35, which are provided for engaging in the groove 23 between the angled limbs 21, 22. Furthermore, on its opposite longitudinal peripheries, the connection body 30 has a respective limb 36, 37 which is angled on the rear side, wherein the limbs 36, 37 are each designed for arranging in the respective limb groove 26, 27 between the respective peripheral limb 24, 25 and the adjacent angled limb 21, 22.

Furthermore, a screw-connection through-opening 38 for a punching screw 39 is provided in the connection body 30. This screw-connection serves for fixing the further fitting part to the drive rod 8.

Otherwise, the connection body 30 has a respective protrusion 42, 43 on the two end sides 40, 41. Each of the protrusions 42, 43 is configured in a wedge-shaped manner in two respects, that is to say, for the one part, in and counter to the longitudinal direction of the connection body 30. In this case, the two protrusions 42, 43 taper towards their free ends. Furthermore, the protrusions 42, 43 are each also provided with a slope 44 on the underside, however. The protrusions 42, 43 assist the arrangement and correct orientation of the further fitting part on the drive rod 8. Otherwise, the connection body is mirror-symmetrical with regard to the foot 33, the limbs 36, 37, the screw-connection opening 38 and/or the protrusions 42, 43.

Figure 3:
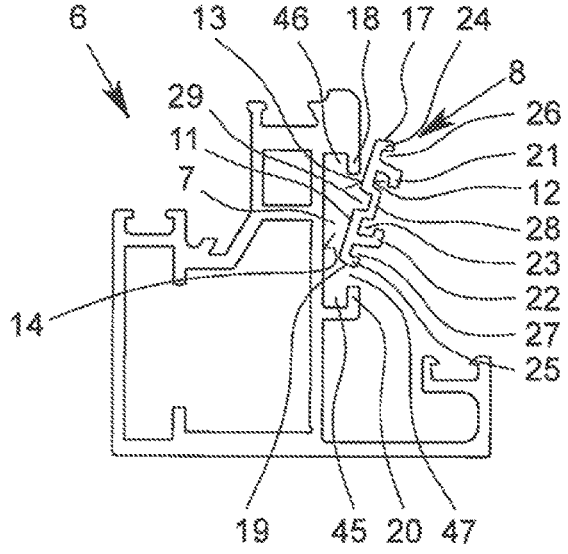
FIGS. 3 to 5 show side views of the frame profile during the insertion of the fitting part into the casement/leaf groove in the frame profile.
Figure 4:
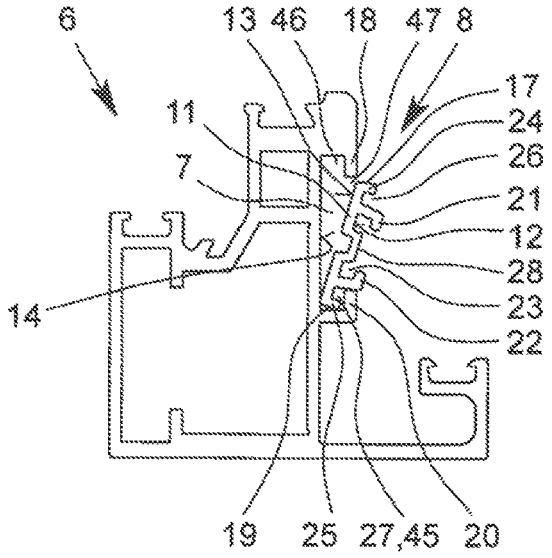
Figure 5:
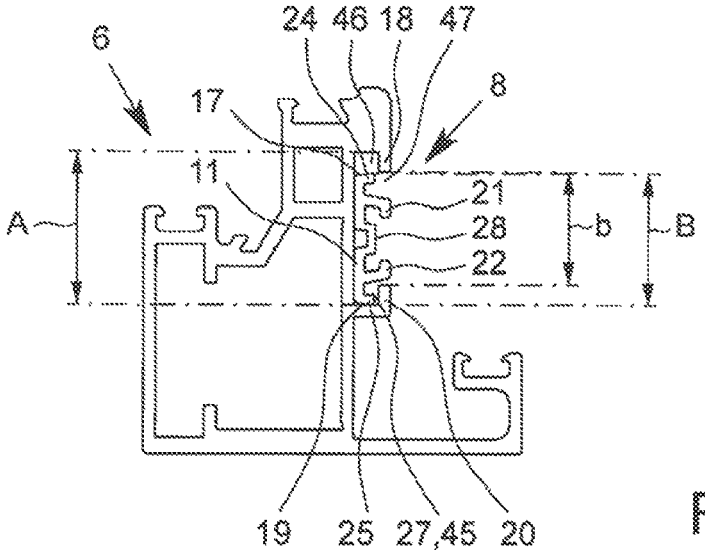

The installation of the drive rod 8 in the frame profile 6 is illustrated in FIGS. 3 to 5. The drive rod 8 is installed frontally and, to this end, is inserted obliquely into the casement groove 7. In the exemplary embodiment illustrated, the peripheral region 19 is inserted obliquely into the groove portion 45, which is formed by the groove limb 18, as is illustrated in FIG. 4. In principle, however, it is also possible to insert the drive rod 8 into the groove portion 46 via the other peripheral region 17 and then pivot it in differently from the way in which this is illustrated in FIG. 4. The groove opening 47 provided between the free ends of the groove limbs 18, 20 has a width b that is smaller than the width B of the drive rod 8. However, the distance A between the groove bottom of the groove portion 45 and the groove bottom of the groove portions 46 is greater than the width B of the drive rod 8. These size ratios ultimately make it possible for the drive rod 8, once placed in position in a groove portion 45, 46, to be pivoted into the casement groove 7, as is illustrated in FIG. 5.

Figure 6:
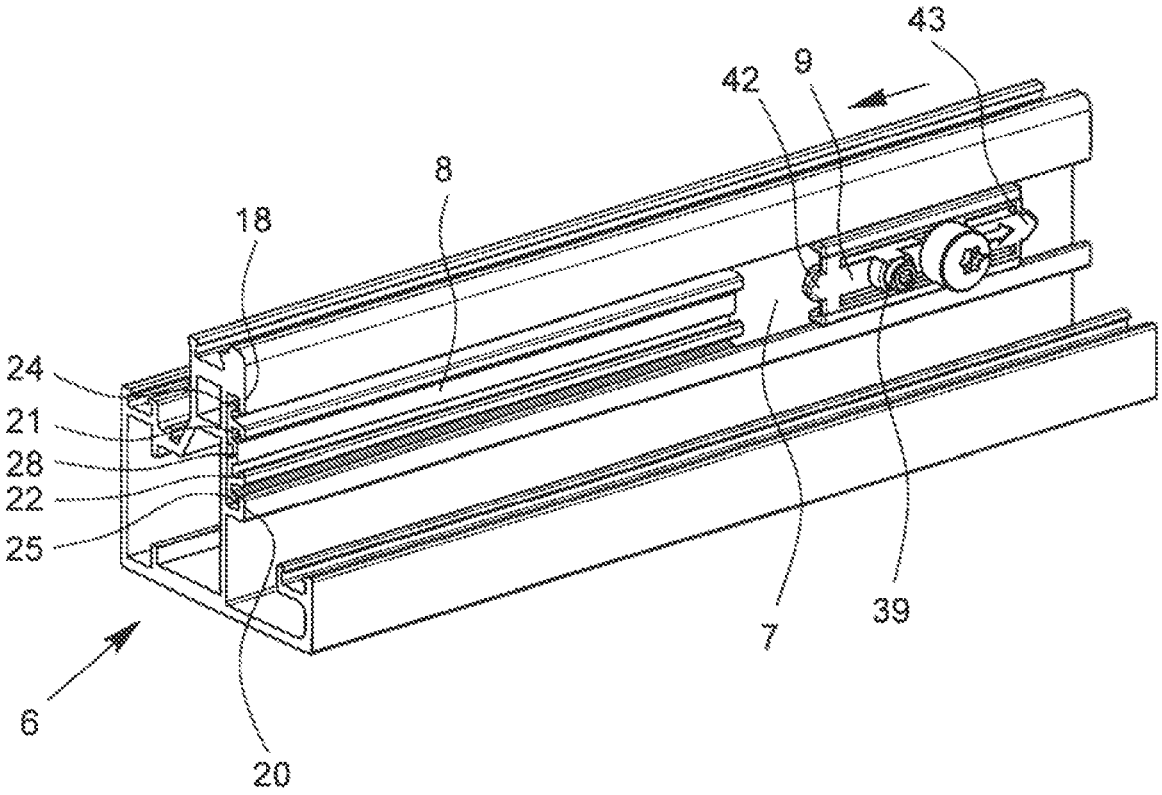
FIG. 6 shows a perspective illustration of part of the frame profile with the fitting part and further fitting part inserted.
Figure 7:
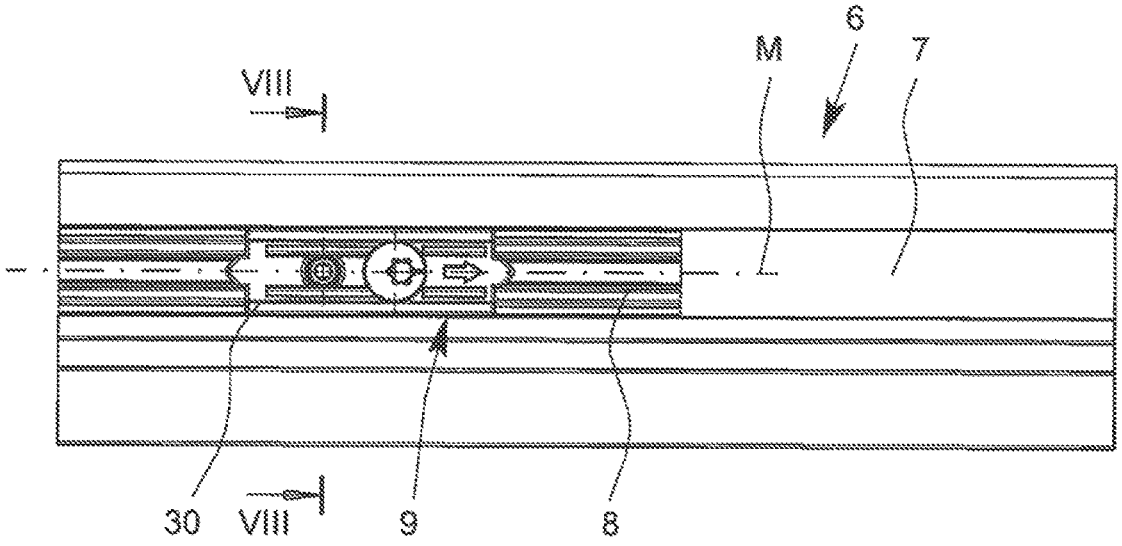
FIG. 7 shows a view of the fitting-part arrangement pre-installed in the frame profile.
Figure 8:
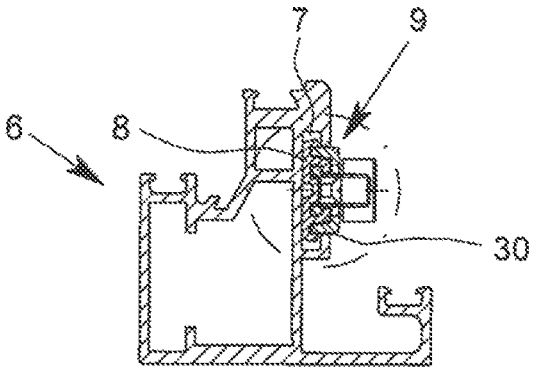
FIG. 8 shows a sectional view from FIG. 7 taken along the section line VIII-VIII in FIG. 7.
Figure 9:
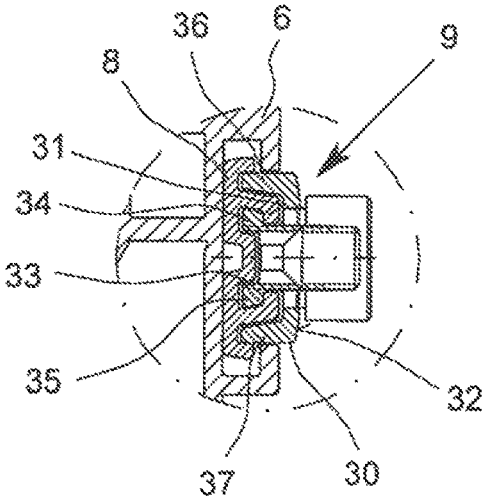
FIG. 9 shows an enlargement of a detail from FIG. 8.

As a rule, following installation of the drive rod 8 in the manner described above, the closing mechanism 9 is inserted into the casement groove 7. In this case, the closing mechanism 9 is placed alongside the drive rod 8, as is illustrated in FIG. 6. The insertion of the closing mechanism 9 into the groove opening 47 of the casement groove 7 requires the distance between the outer sides of the limbs 36, 37 to be the same as or smaller than the width b of the groove opening 47. Once the closing mechanism 9 has been inserted into the casement groove 7, the closing mechanism 9 is moved in the direction of the drive rod 8, as is illustrated in FIG. 6. In contrast to the position illustrated in FIG. 6, the drive rod has the peripheral limb 25 resting on the groove bottom of the groove portion 45, as is shown in FIG. 5. When the closing mechanism 9 is moved in the direction of the drive rod 8, the protrusion 42 penetrates into the groove 23 and raises the latter within the casement groove 7 and centres the drive rod 8 in the casement groove 7. The slope 44 on the underside of the protrusion 42 makes it easier for the closing mechanism 9 to run onto the drive rod 8. The closing mechanism 9 is then pushed into the desired position on the drive rod 8. This is illustrated in FIG. 7. In this state, the limbs 36, 37 of the connection body 30 engage in the limb grooves 26, 27 of the main body 11. Moreover, the foot 33 has its engagement protrusions 34, 35 located in the groove 23, wherein the engagement protrusions 34, 35 engage behind the angled limbs 21 and 22. This is shown in FIGS. 8 and 9.

Figure 10:
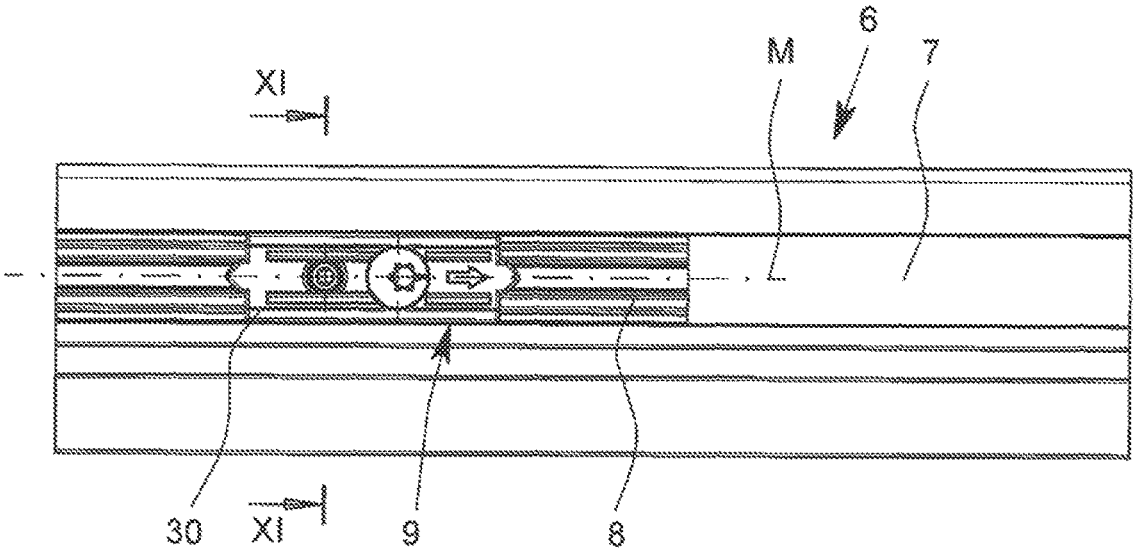
FIG. 10 shows a view of a fitting-part arrangement installed in the frame profile.
Figure 11:
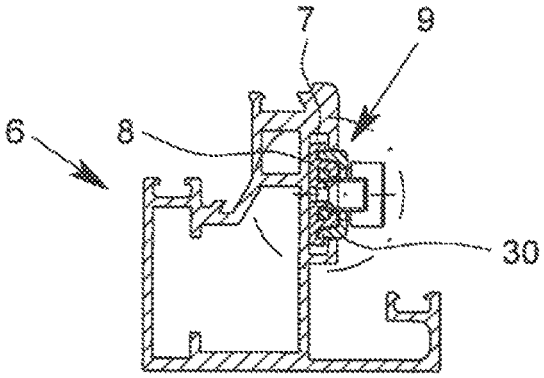
FIG. 11 shows a sectional view taken along the section line XI-XI in FIG. 10.
Figure 12:
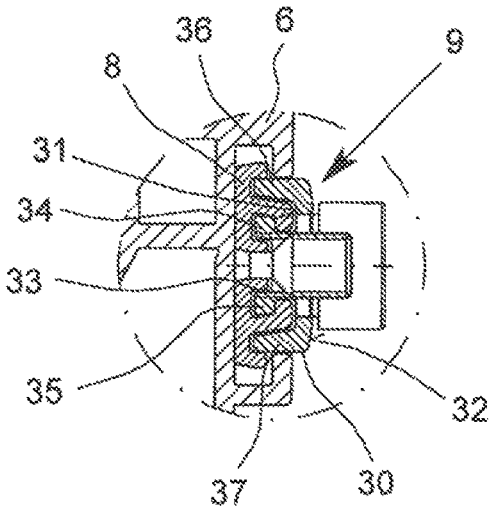
FIG. 12 shows an enlarged illustration of a detail from FIG. 1.

The closing mechanism 9 is subsequently fixed on the drive rod 8 by the punching screw 39 being tightened, as can be seen from FIGS. 10 to 12. In particular FIG. 12 shows that the punching screw 39 passes through the main body 11 by way of its end-side punching extension, and this results in a fixed connection between the drive rod 8 and the closing mechanism 9 in the region of the screw-connection. Punching residues that are produced during punching are received in the free space 29 in the main body 11.

It should be noted that it is also possible, in principle, for the closing mechanism 9 not to be arranged laterally alongside the drive rod 8 and then to be pushed onto the drive rod 8, but rather for the closing mechanism 9 to be placed in position directly on the drive rod 8, with the foot 33 being inserted into the groove 23, and the limbs 36, 37 being inserted into the limb grooves 26, 27, in the process.

Figure 13:
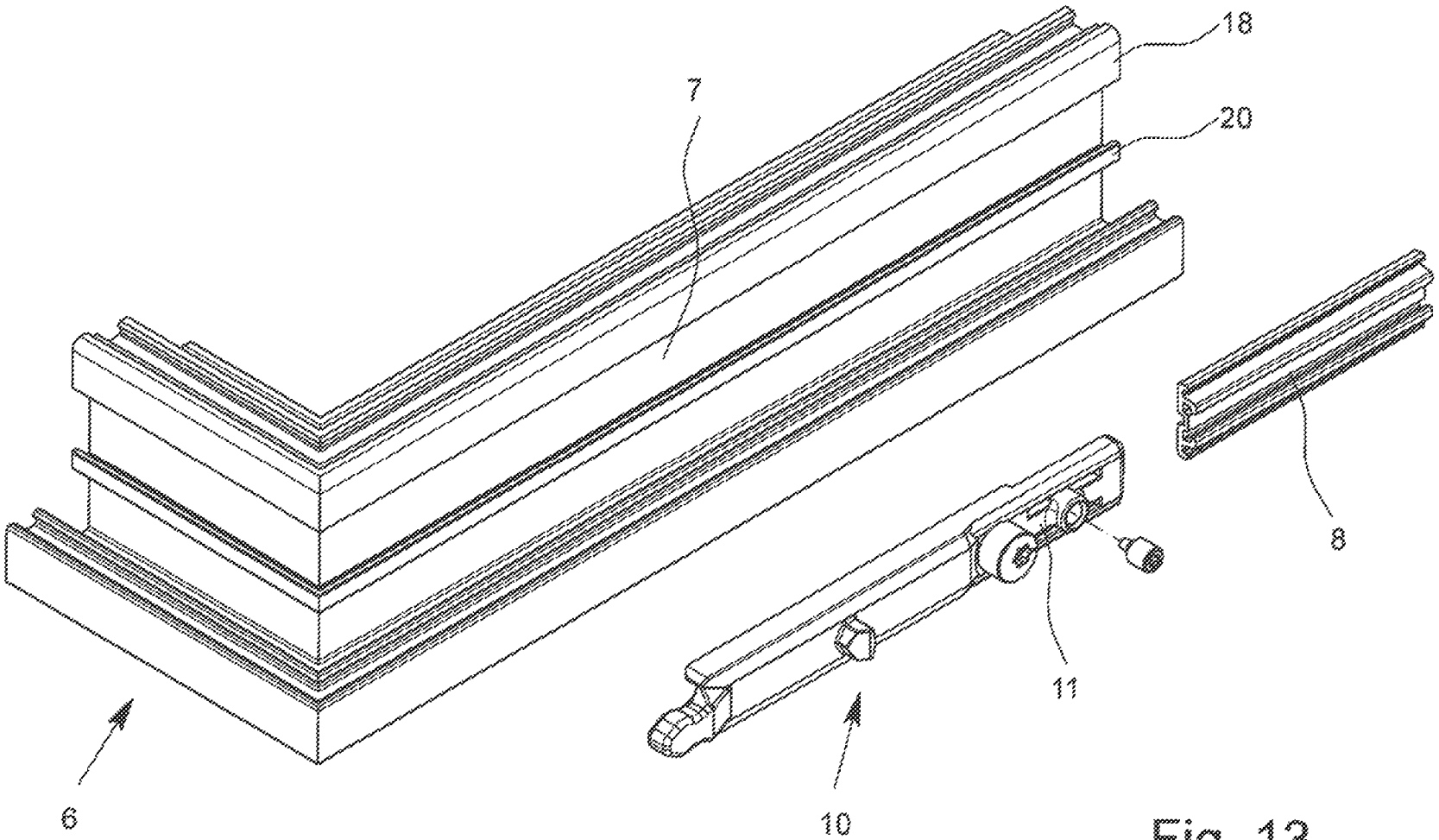
FIG. 13 shows a perspective illustration of part of a frame profile with a fitting part and a different further fitting part.
Figure 14:
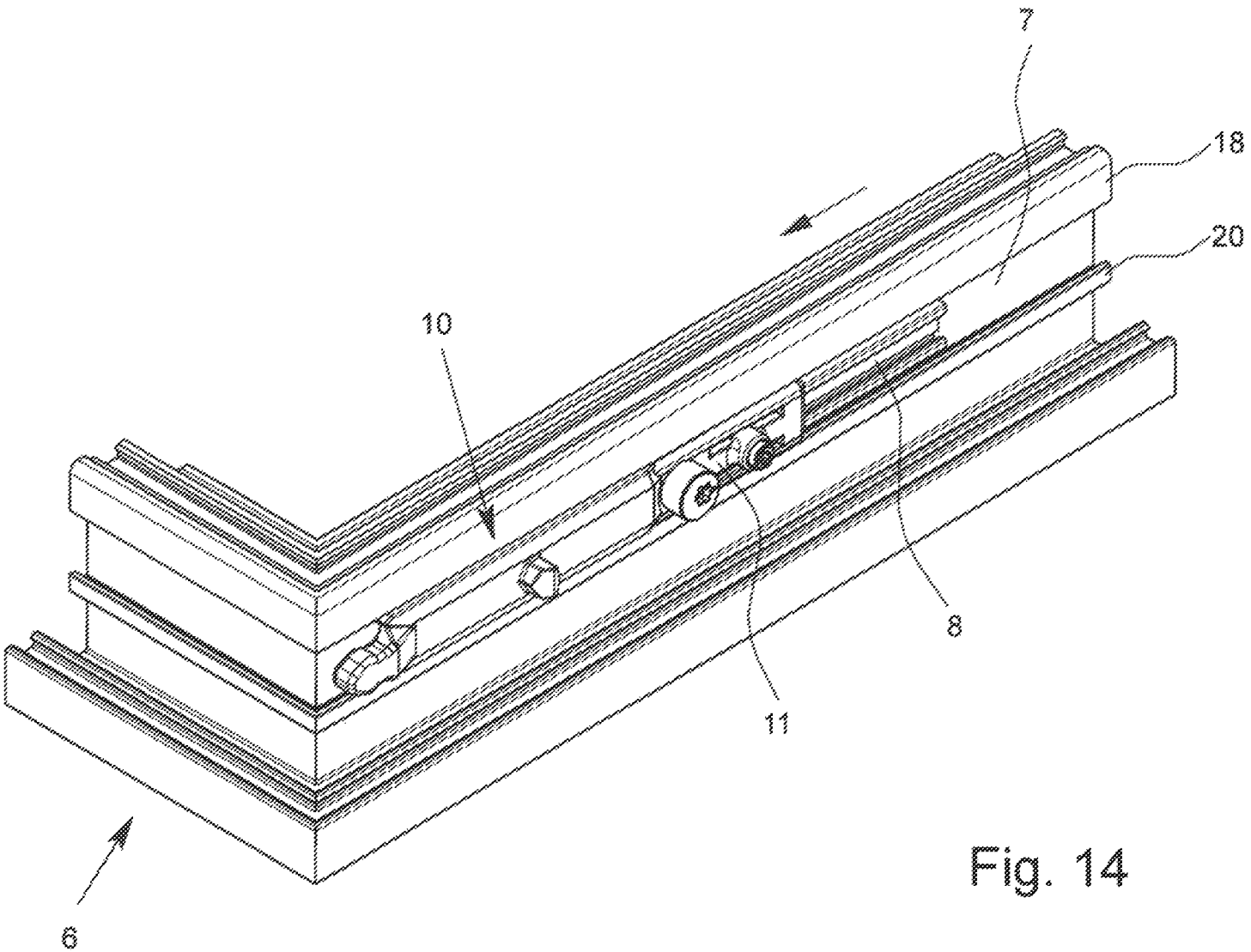
FIG. 14 shows a perspective illustration of the fitting-part arrangement from FIG. 13 in the installed state.

FIGS. 13 and 14 illustrate an embodiment in which, rather than a closing mechanism 9, a tilt-locking device 10 is provided. The main body 11 is in this case part of the body of the tilt-locking device. At the end, the tilt-locking device 10, or the body thereof, transitions into the main body 11. Even if the main body 11 is formed integrally with the tilt-locking device 10, the shape of the main body 11, which was described above, does not change. Ultimately, instead of the tilt-locking device 10 illustrated, it is also possible for some other fitting part, as mentioned above, to be provided, which is then preferably formed integrally with the main body 11, wherein the main body 11 is then provided on the end side of the fitting part in question.

FIGS. 15 to 26 then illustrate embodiments in which the drive rod 8, representing the first fitting part, is configured differently from the drive rod 8 illustrated in FIGS. 2 to 14. The closing mechanism 9, or the shape and configuration of the corresponding fastening elements on the underside of the closing mechanism 9, which is described as representing the further fitting part, is adapted to the drive rod 8, or the profile of the drive rod 8.

Figure 15:
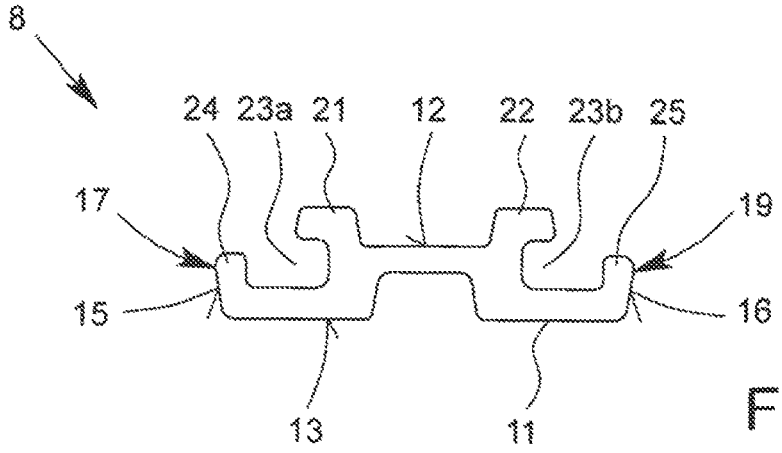
FIG. 15 shows a cross-sectional view of a further embodiment of a fitting part according to the invention.
Figure 16:
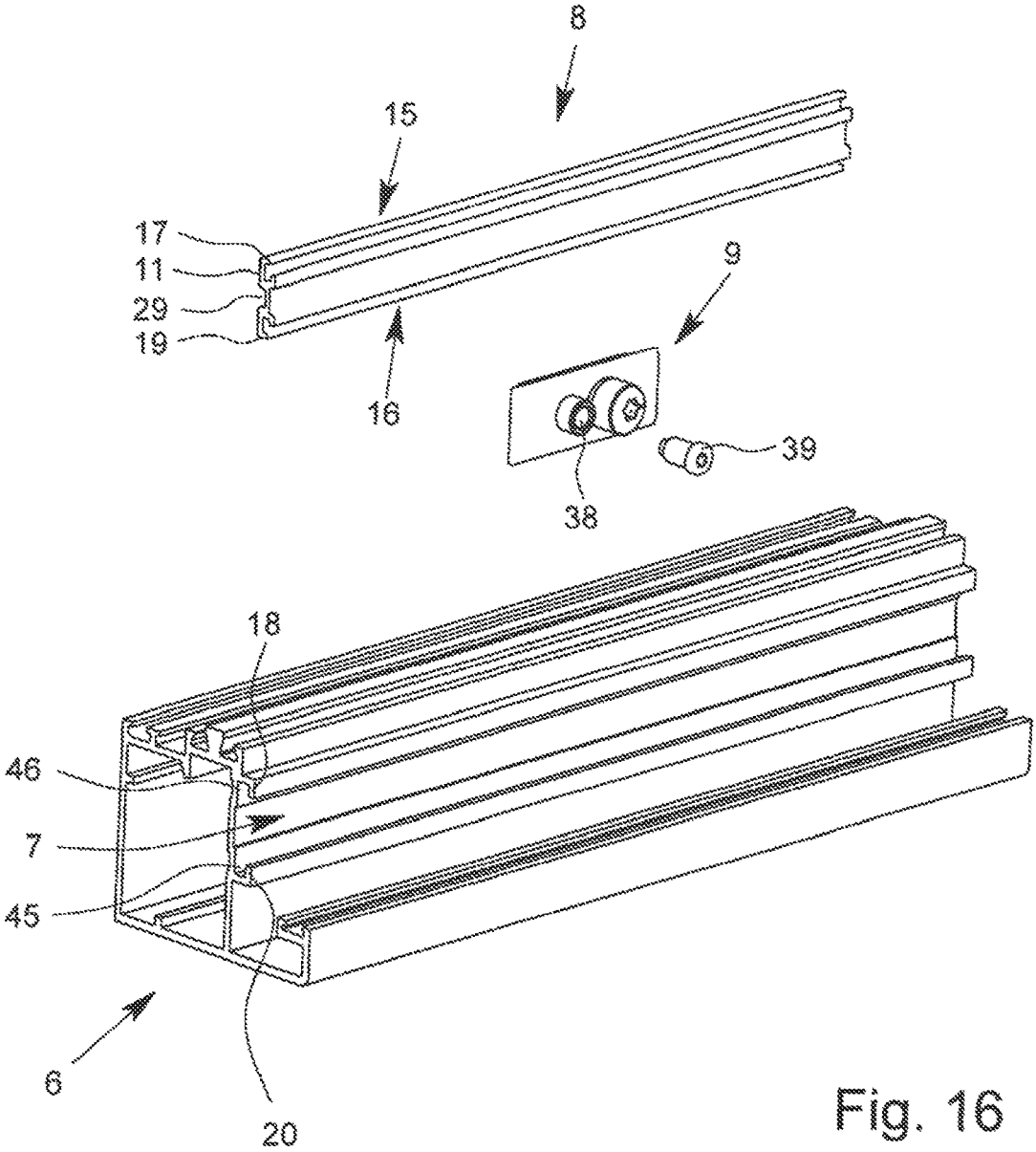
FIG. 16 shows an exploded illustration of part of a casement/leaf arrangement according to the invention.
Figure 17:
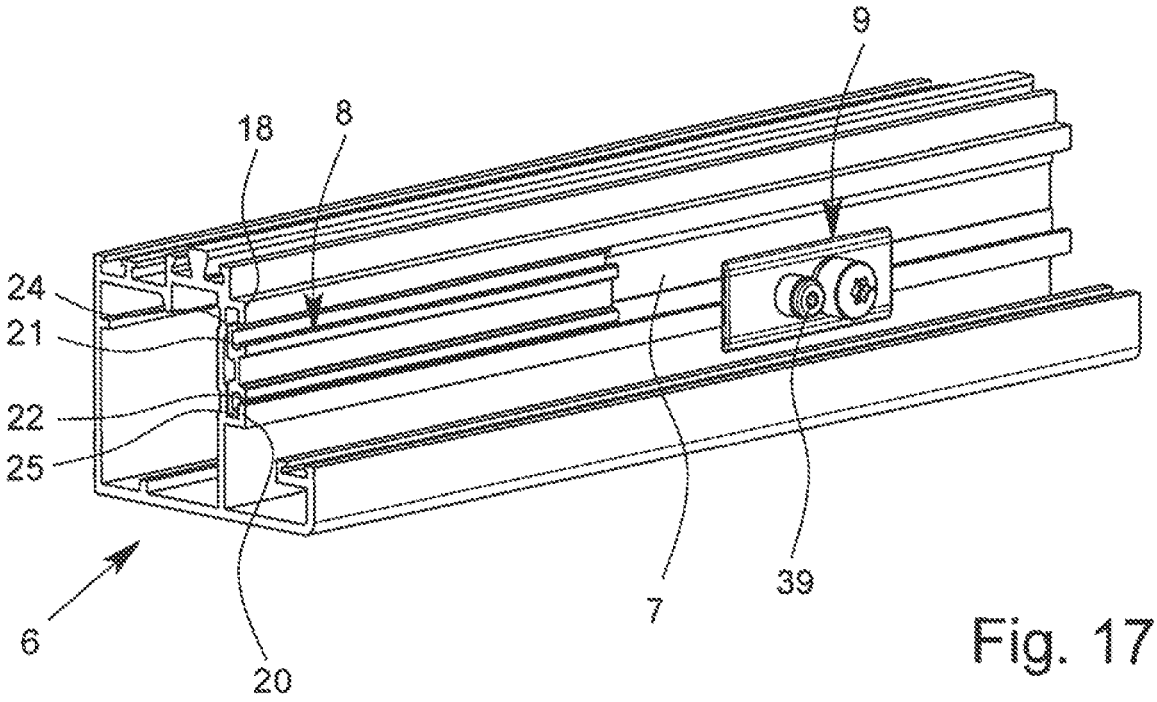
FIG. 17 shows a perspective illustration of the casement/leaf arrangement with the fitting part already installed.
Figure 18:
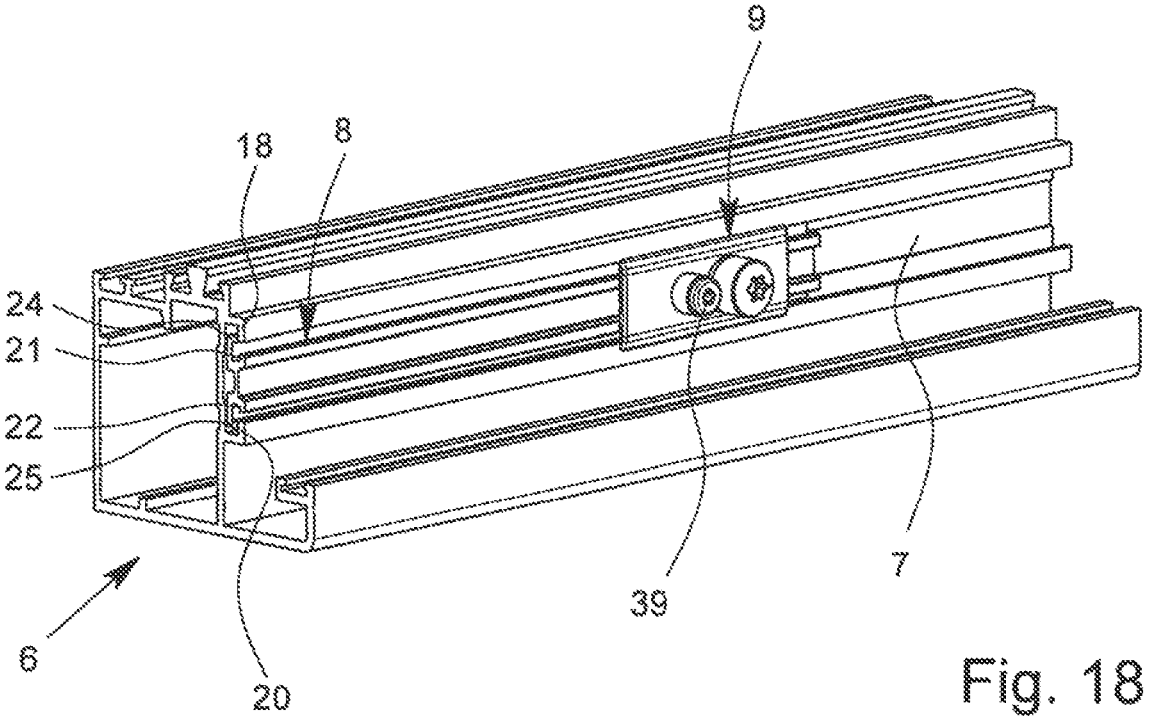
FIG. 18 shows an illustration corresponding to FIG. 17 with the further fitting part installed.
Figure 19:
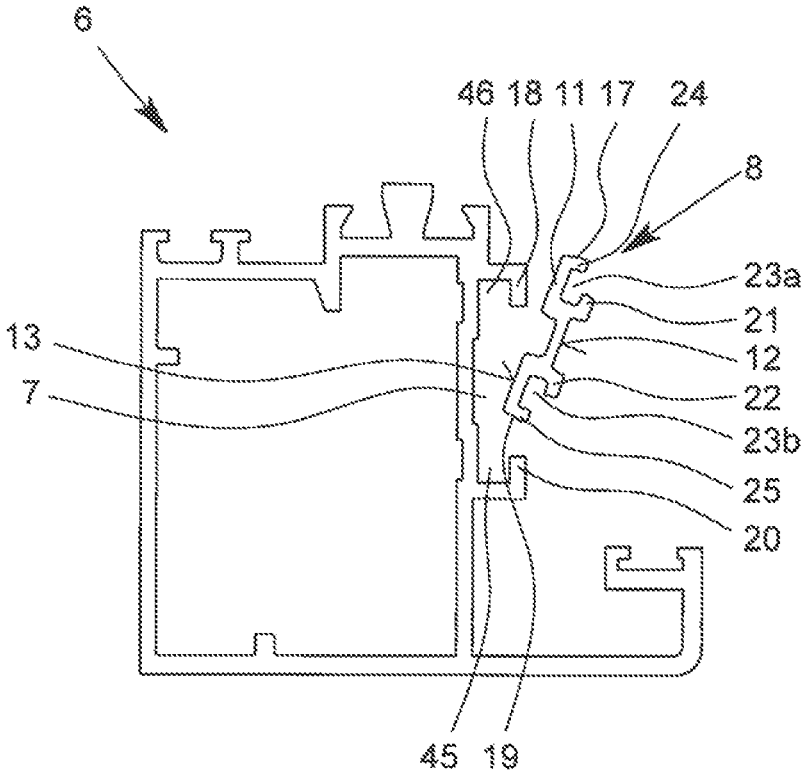
FIG. 19 shows a cross-sectional illustration of a frame profile with the fitting part placed obliquely.

As can be gathered in particular from FIG. 15, peripheral limbs 24, 25 that protrude in each case on the front side are provided on the two longitudinal sides 15, 16 of the main body 11 in the respective peripheral regions 17, 19. The peripheral limbs 24, 25 serve for engaging behind the groove limbs 18, 20 of the casement groove 7. In this case, it is ultimately the respective longitudinal side 15, 16 of the main body 11 that is angled in order to form the respective peripheral limb 24, 25.

Furthermore, two spaced-apart angled limbs 21, 22 are provided on the front side of the main body 11, the free ends of said angled limbs 21, 22—in contrast to the above-described embodiment—being directed away from one another. The respective angled limbs 21, 22 face in the direction of the associated peripheral limbs 24, 25, wherein in each case one peripheral groove 23*a*, 23*b* is produced in the respective peripheral region 17, 19.

Figure 20:
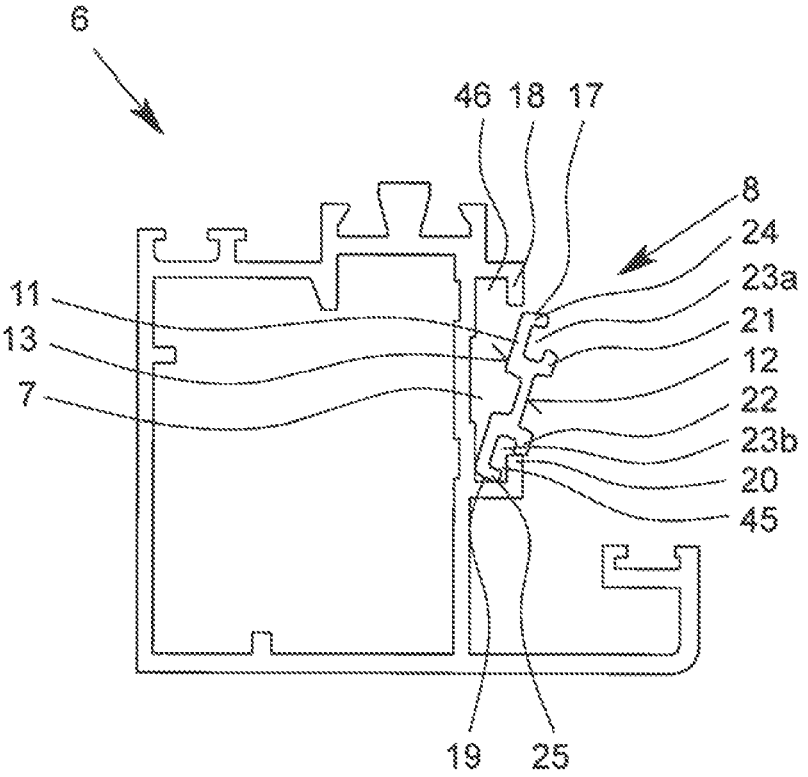
FIG. 20 shows a view corresponding to FIG. 19 with the fitting part inserted obliquely into the casement/leaf groove in the frame profile.
Figure 21:
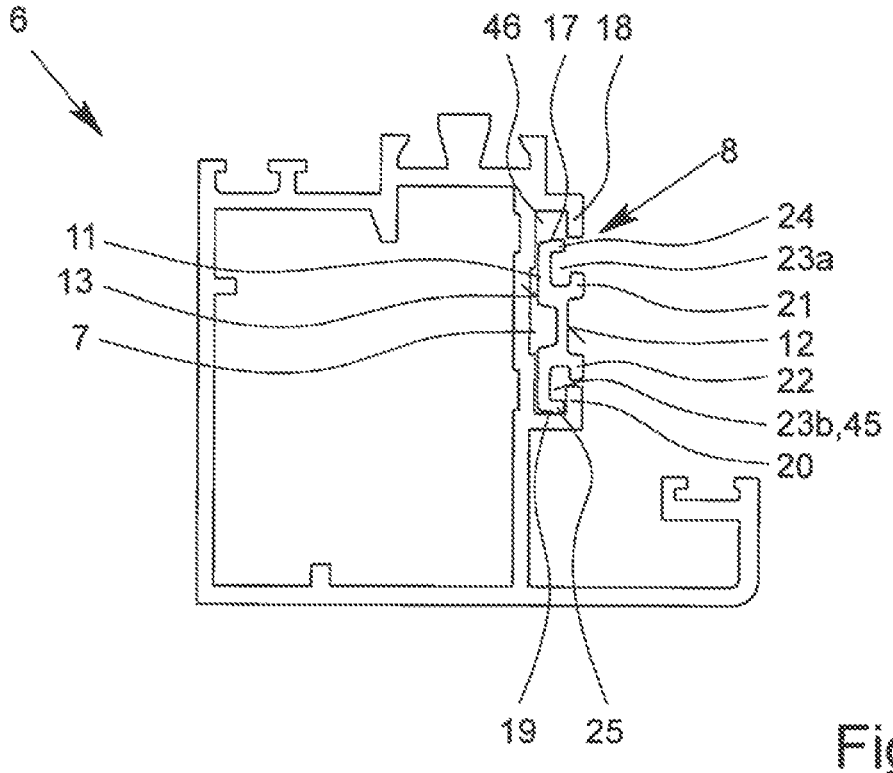
FIG. 21 shows a view corresponding to FIG. 20 with the fitting part inserted completely into the casement/leaf groove.

As a result, the drive rod 8 thus has a respective peripheral groove 23*a*. 23*b* on both longitudinal sides 15, 16. In this case, the length of the free ends of the angled limbs 21, 22 should be selected such that there is still an undercut on the respective peripheral groove 23*a*. 23*b*, but that the respective angled limb 21, 22 does not collide with the respective groove limb 18, 20, or the length thereof, so as to impede or even prevent the drive rod 8 from being pivoted into the casement groove 7. FIG. 20 illustrates the state in which it is still readily possible to pivot the drive rod 8 into the casement groove 7.

Figure 22:
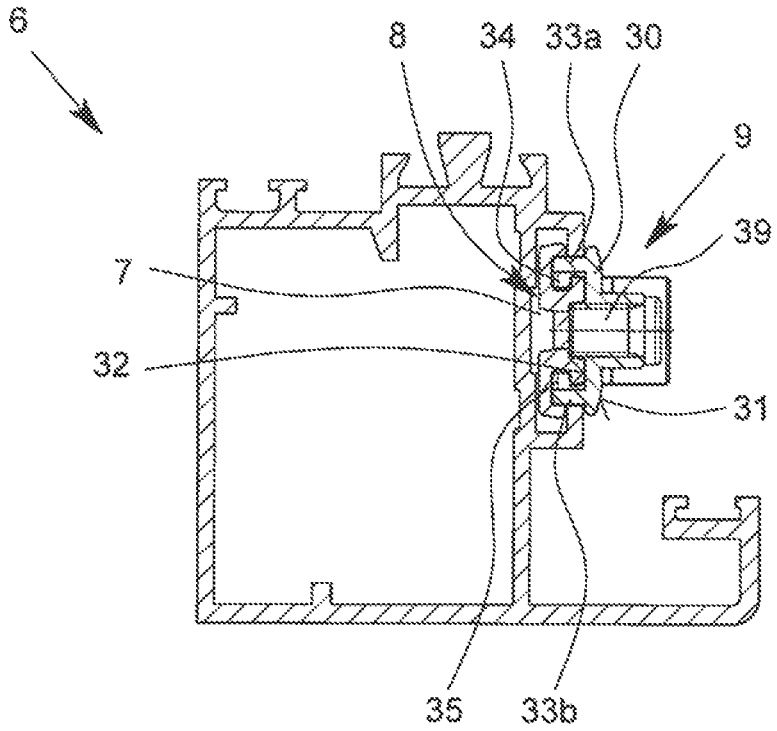
FIG. 22 shows a view corresponding to FIG. 21 in cross section with the further fitting part fastened to the fitting part.

The configuration of the closing mechanism 9 as a further fitting part on the underside corresponds to the modified configuration of the profile of the drive rod 8. The closing mechanism 9 has, on the rear side 31 of its connection body 30, two feet 33*a*, 33*b*, which each have an engagement protrusion 34, 35. The feet 33*a*, 33*b*, with their engagement protrusions 34, 35, are provided to engage in each case in a peripheral groove 23*a*, 23*b*, as is illustrated in FIG. 22.

In the embodiment illustrated, the closing mechanism 9 is pushed laterally onto the drive rod 8 and is subsequently fastened to the drive rod 8 via the punching screw 39. As can be gathered in particular from FIG. 22, the distance between the outer sides of the feet 33*a*, 33*b* is the same as or slightly smaller, that is to say smaller than 2 mm, than the width of the groove opening of the casement groove 7. As can otherwise be gathered from FIG. 22, not only the feet 33*a*, 33*b* engage in the peripheral grooves 23*a*, 23*b* in the installed state of the closing mechanism 9. In the installed state of the fitting part, or of the drive rod 8, the peripheral limbs 24, 25 of the drive rod 8 each engage behind a groove limb 18, 20 of the casement groove 7.

Figure 23:
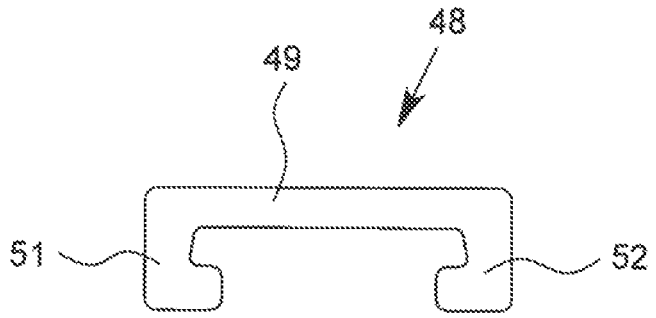
FIG. 23 shows a view of a first embodiment of a cover.
Figure 24:
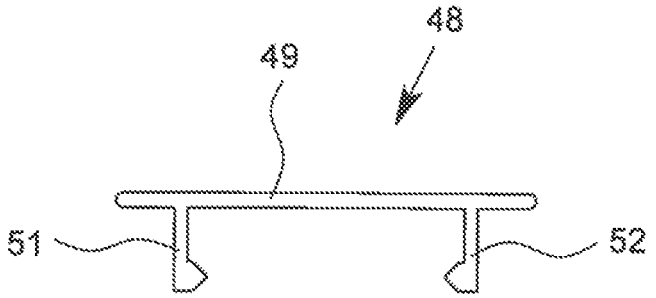
FIG. 24 shows a view corresponding to FIG. 23 of a further embodiment of a cover.

FIGS. 23 and 24 show different embodiments of a cover 48, which is provided to at least regionally cover the top or front side 12 of the main body 11. The cover 48 is releasably connectable to the main body 11. In the embodiment illustrated in FIG. 23, the cover 48 is able to be pushed onto the main body 11 of the drive rod 8, while it is able to be latched on in the embodiment according to FIG. 24. Specifically the cover 48 has a top-side covering rail 49 and feet 51, 52 on the underside. In the embodiment illustrated in FIG. 24, the feet 51, 52 are configured as latching limbs with corresponding latching protrusions. In particular when the feet 51, 52 are configured as latching limbs, the cover 48 can be latched into the peripheral grooves 23*a*, 23*b*. In this respect, too, frontal installation of the cover 48 is possible. In the embodiment according to FIG. 23, the cover 48 is pushed into the peripheral grooves 23*a*, 23*b*. However, if the covering rail 49 and/or the feet 51, 52 consist of an elastic material, it is also possible to install the cover 48 frontally.

Figure 25:
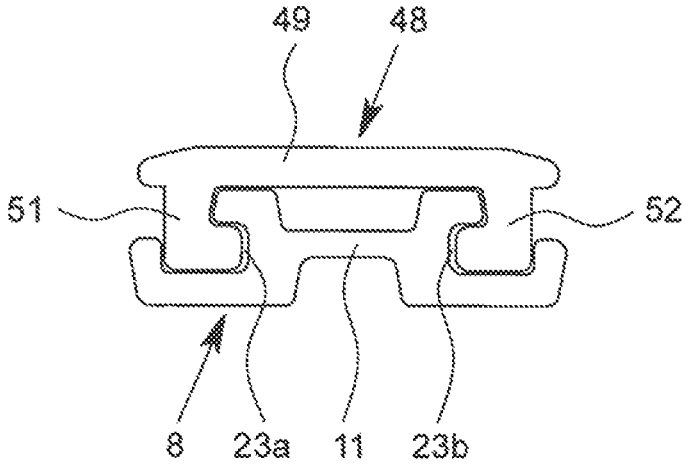
FIG. 25 shows an illustration of a further cover in the state placed on the fitting part.

As FIGS. 23 to 25 otherwise show, the covering rail 49 can protrude laterally beyond the feet 51, 52, but does not have to. In the installed state, the overhang can extend externally to over the groove limbs 18, 20. However, it is also possible for the groove limbs each to transition at the end into the covering rail 49.

Figure 26:
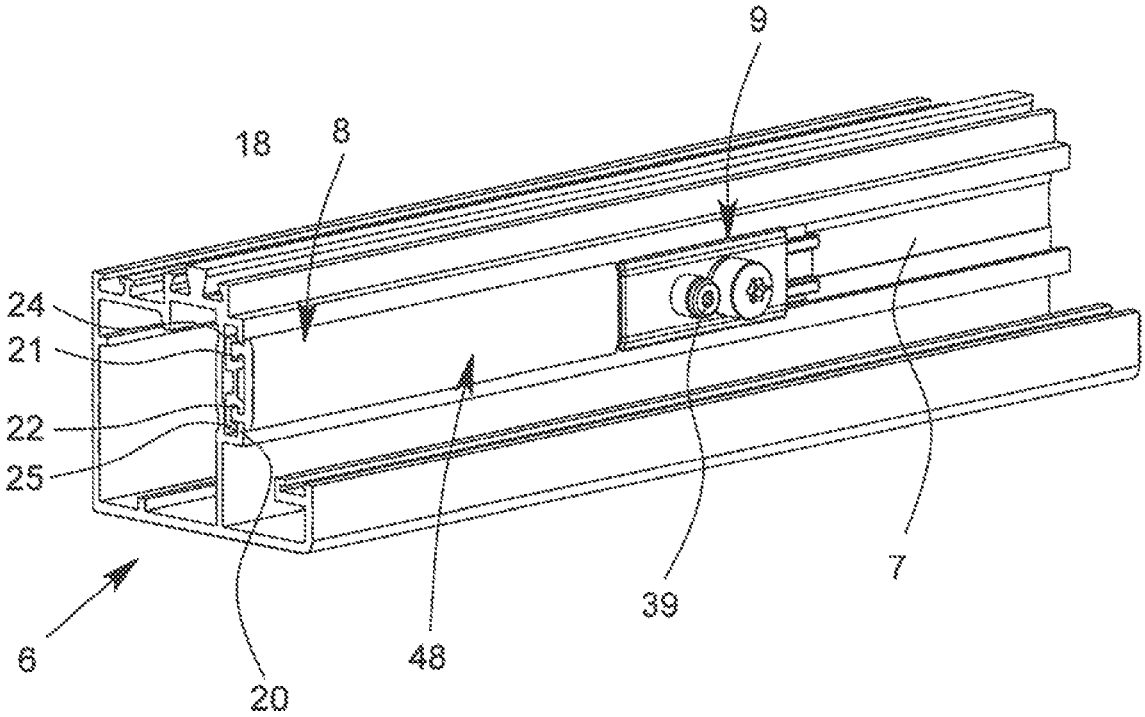
FIG. 26 shows an illustration corresponding to FIG. 18 with the cover fastened to the fitting part.

Otherwise, the cover 48 has an elongate shape, as can be gathered in particular from FIG. 26. The cover 48 can in particular have on its underside a plurality of predetermined breaking points and also a plurality of feet 51, 52 in order for it to be possible to shorten the cover 48 in terms of length if necessary.

As far as the installation of the drive rod 8 is concerned, it is immaterial whether the angled limbs 21, 22 on the front side 12 of the main body 11 are directed towards one another or away from one another. The pivoting-in movement is in each case the same, as can be gathered from a comparison of FIGS. 3 to 5 and of 19 to 21.

Otherwise, it goes without saying that all of the features described in connection with FIGS. 2 to 14 can be provided in the same way in the embodiment according to FIGS. 15 to 26, and vice versa. This goes in particular also for the realization of the cover 48 in the embodiment according to FIGS. 2 to 14. In this case, it is only the feet 51, 52 that have to be configured in a different way. In principle, it is also possible to realize only one foot.

| List of reference signs: | |
|---|---|
| 1 | Casement/leaf arrangement |
| 2 | Casement/leaf |
| 3 | Frame |
| 4 | Handle |
| 5 | Fitting |
| 6 | Frame profile |
| 7 | Casement/leaf groove |
| 8 | Drive rod |
| 9 | Closing mechanism |
| 10 | Tilt-locking device |
| 11 | Main body |
| 12 | Front side |
| 13 | Rear side |
| 14 | Bottom |
| 15 | Longitudinal side |
| 16 | Longitudinal side |
| 17 | Peripheral region |
| 18 | Groove limb |
| 19 | Peripheral region |
| 20 | Groove limb |
| 21 | Angled limb |
| 72 | Angled limb |
| 23 | Groove |
| 23a | Peripheral groove |
| 23b | Peripheral groove |
| 24 | Peripheral limb |
| 25 | Peripheral limb |
| 26 | Limb groove |
| 27 | Limb groove |
| 28 | Elevation |
| 29 | Free space |
| 30 | Connection body |
| 31 | Rear side |
| 32 | Front side |
| 33 | Foot |
| 33a | Foot |
| 33b | Foot |
| 34 | Engagement protrusion |
| 35 | Engagement protrusion |
| 36 | Limb |
| 37 | Limb |
| 38 | Screw-connection opening |
| 39 | Punching screw |
| 40 | End side |
| 41 | End side |
| 42 | Protrusion |
| 43 | Protrusion |
| 44 | Slope |
| 45 | Groove portion |
| 46 | Groove portion |
| 47 | Groove opening |
| 48 | Cover |
| 49 | Covering rail |

-continued

| List of reference signs: | |
|---|---|
| 50 | Latching limb |
| 51 | Foot |
| 52 | Foot |
| A | Distance |
| b | Width |
| B | Width |
| M | Longitudinal centre axis |

The invention claimed is:

1. A casement arrangement comprising a casement of a window or door, with a frame profile of the casement, said frame profile having a C-shaped casement groove in a rebate, and comprising a fitting part with a main body insertable into the casement groove; further comprising a connector releasably connectable to the main body of the fitting part, wherein the casement groove has a first groove limb and a first groove portion and, located opposite, a second groove limb and a second groove portion; wherein the fitting part has an elongate main body having a front side and a rear side with on opposite longitudinal sides, a first peripheral region to engage behind the first groove limb of the casement groove and a second peripheral region to engage behind the second groove limb of the casement groove, wherein the main body of the fitting part is configured in a mirror-symmetrical manner in relation to its longitudinal center axis; and wherein a distance of a groove bottom of the first groove portion or second groove portion from a free end of a groove limb of an opposite groove portion is greater than a width of said at least one fitting part, such that said at least one fitting part is pivotable into the casement groove with the peripheral regions inserted into the groove portions, and wherein the connector comprises a connection body having a rear side and a front side; and further comprising at least one foot, on the rear side of the connection body, having at least one engagement protrusion to engage a groove of the fitting part and further comprising a protrusion, tapering in a wedge-shaped manner towards its free end in a longitudinal direction or on its underside, the connection body being arrangeable between two angled limbs of the fitting part on at least one end side of the connection body and comprises a screw-connection through-opening to receive a punching screw to fix the connector to the fitting part; and wherein the connection body is configured in a mirror-symmetrical manner in relation to its longitudinal center axis with regard to the screw-connection.

2. The casement arrangement according to claim 1, wherein the fitting part is a drive rod of a fitting.

3. The casement arrangement according to claim 1, further comprising peripheral limbs, protruding on the front side of the main body of the fitting part, provided on the longitudinal sides of the fitting part to engage behind the groove limbs of the casement groove.

4. The casement arrangement according to claim 3, wherein the longitudinal sides of the main body of the fitting part are angled to form the peripheral limbs.

5. The casement arrangement according to claim 3, further comprising two peripheral limbs, and two spaced-apart angled limbs provided on the front side of the main body, free ends of said two angled limbs being directed away from one another; and wherein each angled limb forms, with a corresponding peripheral limb, a peripheral groove.

6. The casement arrangement according to claim 3, further comprising two spaced-apart angled limbs provided on the front side of the main body, free ends of said two angled limbs being directed towards one another, to form a C-shaped groove.

7. The casement arrangement according to claim 1, further comprising a cover configured to be placed on the main body of the fitting part to at least substantially cover the front side of the main body.

8. The casement arrangement according to claim 5, further comprising a cover releasably connected to the main body and having a front-side covering rail and, on a rear side, at least one foot, configured as a latching limb, to engage the peripheral groove of the main body.

9. The casement arrangement according to claim 6, further comprising a cover releasably connected to the main body of the fitting part and having a front-side covering rail and, on a rear side, at least one foot, configured as a latching limb, to engage the C-shaped groove of the main body.

10. The casement arrangement according to claim 5, wherein the main body has a channel-like recess on its underside, between the two angled limbs, to form a free space on the underside.

11. A method for a frontal installation of a first fitting part in a C-shaped casement groove in a rebate of a frame profile of a casement/leaf of a window or door of the casement arrangement according to claim 1, wherein the first fitting part is inserted frontally with the first and second peripheral regions obliquely into the first and second groove portions of the casement groove, respectively; and the first fitting part is subsequently pivoted into the casement groove.

12. The method according to claim 11, further comprising a step of placing or pushing either a second fitting part or a cover onto the fitting part.

13. The method according to claim 12, further comprising steps of inserting the second fitting part into the casement groove at a different location from the first fitting part; either moving one fitting part in a direction of other fitting part or moving the first and second fitting parts towards one another in the casement groove to arrange the second fitting part next to the first fitting part; and connecting the second fitting part to the first fitting part.

* * * * *